United States Patent [19]

Cromer et al.

[11] 4,123,636

[45] Oct. 31, 1978

[54] DOUBLE-FLOW PUFFER-TYPE SINGLE-PRESSURE COMPRESSED-GAS CIRCUIT-INTERRUPTER

[75] Inventors: Charles F. Cromer, Penn Township, Allegheny County; Kue H. Yoon, Pittsburgh; Willie B. Freeman, Monroeville, all of Pa.

[73] Assignee: Westinghouse Electric Corp., Pittsburgh, Pa.

[21] Appl. No.: 645,752

[22] Filed: Dec. 31, 1975

[51] Int. Cl.[2] ..... H01H 33/88

[52] U.S. Cl. ..... 200/148 A; 200/150 G

[58] Field of Search ..... 200/148 A, 150 G

[56] References Cited

U.S. PATENT DOCUMENTS

| | | | |
|---|---|---|---|
| 3,257,532 | 6/1966 | Lerch | 200/148 A |
| 3,291,948 | 12/1966 | Telford | 200/148 A |
| 3,331,935 | 7/1967 | Milianowicz | 200/148 A |
| 3,786,215 | 1/1974 | Mauthe | 200/148 A |
| 3,839,613 | 10/1974 | Tsubaki et al. | 200/148 A |
| 3,941,962 | 2/1976 | Thaler | 200/148 A |

*Primary Examiner*—Robert S. Macon
*Attorney, Agent, or Firm*—W. A. Elchik

[57] ABSTRACT

An improved puffer-type compressed-gas circuit-interrupter is provided having double-flow gas-flow conditions occurring in opposite directions within the arcing region, and providing thereby adaptability for high-current interrupting duty.

Additional features moreover include a relatively-stationary tubular arcing contact for improved venting of the hot arcing gases, secondary circumferentially-disposed movable contact fingers making contacting engagement with said tubular stationary venting arcing contact improved main contact structure.

8 Claims, 10 Drawing Figures

OPEN POSITION

FIG. 2
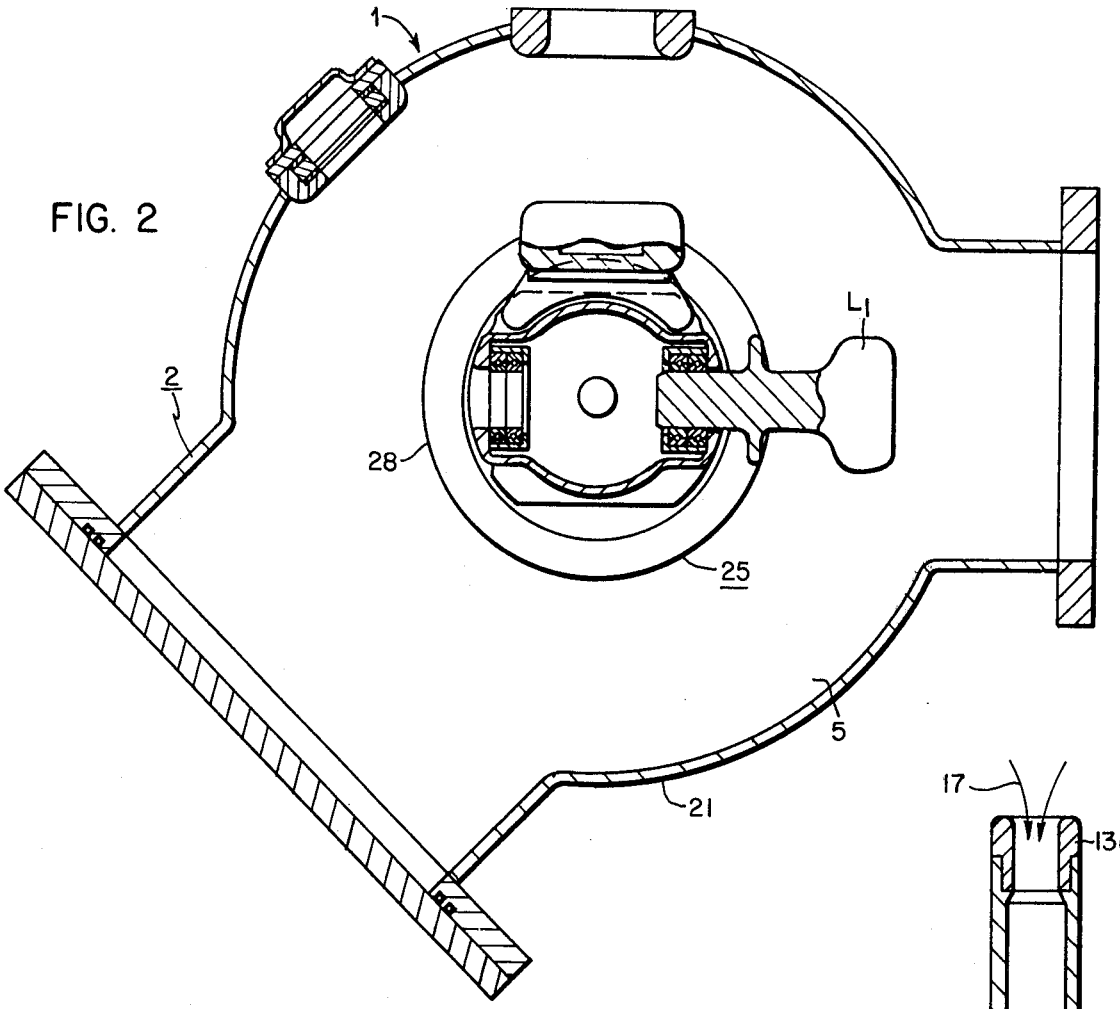
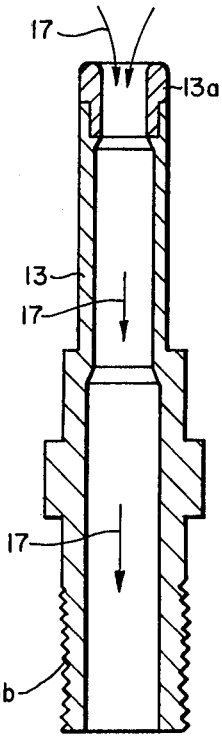
FIG. 8

OPEN POSITION

CLOSED POSITION

ARCING POSITION

INITIAL OPENING MOVEMENT

DOUBLE-FLOW PUFFER-TYPE SINGLE-PRESSURE COMPRESSED-GAS CIRCUIT-INTERRUPTER

CROSS-REFERENCE TO RELATED APPLICATIONS

Reference may be made to U.S. Pat. application filed Dec. 31, 1975, Ser. No. 645,753 by T. E. Alverson et al, entitled "Circuit Breaker", and U.S. Pat. application filed Dec. 31, 1975, Ser. No. 645,867 by Russell N. Yeckley et al, entitled "Circuit Breaker", U.S. Pat. application filed Mar. 21, 1975, Ser. No. 560,461 by Joseph R. Rostron, entitled "Double-Puffer-Type Compressed-Gas Circuit-Interrupter Constructions", U.S. Pat. application filed May 12, 1975, Ser. No. 576,820 by Joseph R. Roston. Other applications, which may be referred to, are U.S. Pat. application filed May 12, 1975, Ser. No. 576,820, by Joseph Rostron; U.S. Pat. application filed Aug. 7, 1975, Ser. No. 602,705, by Cromer et al; U.S. Pat. application filed Sept. 25, 1975, Ser. No. 616,703, by Rostron et al; U.S. Pat. application filed Mar. 11, 1976, Ser. No. 665,823, by Charles F. Cromer et al. U.S. Pat. application filed Sept. 21, 1976, Ser. No. 725,313, by Charles F. Cromer et al. all of said patent applications being assigned to the assignee of the instant patent application.

BACKGROUND OF THE INVENTION

In recent years there has come about a demand for a reduced-size substation, and this demand, on the part of public utilities, has been met by gas-insulated substation equipment, such as set forth in U.S. Pat. Nos. 3,378,731, Whitehead; 3,348,001, Upton et al; 3,801,768, Meyer 3,794,797, Spindle et al; 3,356,798, McKinnon; 3,610,858, Gruber et al; 3,599,041, Boersma et al and 3,562,460, Koener.

The foregoing equipment significantly reduces the space required by the high-voltage side of substations rated, for example, 115 K.V. through 345 K.V. The space reduction is accomplished by replacing the open bus and air-type terminal bushings with gas-insulated bus, filled, for example, with a highly-insulating gas, such as sulfur-hexafluoride ($SF_6$) gas, at a pressure say, for example, 45 p.s.i.g., and thereby permitting the location of electrical equipment very close together. This gas-insulated substation equipment has many advantages, among which are:

1. Significant reduction in space requirements both in land area and overall height.
2. Added system reliability by eliminating the possibility of phase-to-phase faults, lightning strokes within the system, or contamination of insulators.
3. Reduced maintenance because the closed system is isolated from its environment.
4. Added personnel safety because all live parts are covered by grounded shields.
5. The gas-insulated modular approach has the additional advantage, because it provides the utility user with lower installation costs, when compared with conventional, or other types of power-transmission systems.

The gas-insulated system, as briefly described above, has additional design strategies, inasmuch as the high-voltage power-transmission and control equipment is compressed, so that both the space required, and the total length of bus is minimized. The power transformers may be located on outside corners of the station so as to be capable of ready removal, and the location of cable potheads is flexible, with the result that the system may be readily connected to overhead power lines.

As examples of the types of ratings for such gas-insulated power transmission systems, reference may be made to the specification ratings, as set forth below:

| | |
|---|---|
| 115/138 k.v. Ratings | |
| General Ratings for MGT Systems | $SF_6$ at 45 psig |
| Rated maximum voltage | 145 |
| Bil | 650 |
| 60 HZ one minute withstand | 310 |
| Chopped wave | Not applicable |
| Symmetrical 3 Second Current Rating | 47 ka |
| Momentary Current | 76 ka |
| Switching Current Ratings | |
| Circuit breaker (maximum rated interrupting current) | 50 ka |
| Magnetizing current switch | 35 amps |
| Isolator | No load switching only |
| Ground switch | No load switching only |
| Continuous Current Ratings | |
| Circuit Breaker | 2,500 Amperes |
| Load-break switch | 2,500 Amperes |
| Magnetizing current switch | 2,500 Amperes |
| Isolator | 2,500 Amperes |
| Ground Switch | Not applicable |
| Bus | 3,000 Amperes |
| 230 k.v. Ratings | |
| General Ratings for MGT Systems | $SF_6$ at 45 p.s.i.g. |
| Rated maximum voltage | 242 |
| BIL | 900 |
| 60 HZ-one minute withstand | 425 |
| Chopped wave | Not applicable |
| Symmetrical 3 Second Current Rating | 50 ka |
| Momentary Current | 80 ka |
| Switching Current Ratings | |
| Circuit-breaker (maximum rated interrupting current) | 50 ka |
| Magnetizing current switch | 35 amps. |
| Isolator | No load switching only |
| Ground switch | No load switching only |
| Continuous Current Ratings | |
| Circuit-breaker | 2,500 Amperes |
| Load-break switch | 2,500 Amperes |
| Magnetizing current switch | 2,500 Amperes |
| Isolator | 2,500 Amperes |
| Ground Switch | Not applicable |
| Bus | 3,000 Amperes |
| 345 k.v. Ratings | |
| General Ratings for MGT Systems | $SF_6$ at 45 p.s.i.g. |
| Rated maximum voltage | 362 |
| Bil | 1050 |
| 60 HZ-one minute withstand | 555 |
| Chopped wave | Not applicable |
| Symmetrical 3 Second Current Rating | 50 ka |
| Momentary Current | 80 ka |
| Switching Current Ratings | |
| Circuit-breaker (maximum rated interrupting current) | 50 ka |
| Magnetizing current switch | 35 amps |
| Isolator | No load switching only |
| Ground switch | No load switching only |
| Continuous Current Ratings | |
| Circuit-breaker | 2,500 Amperes |
| Load-break switch | 2,500 Amperes |
| Magnetizing current switch | 2,500 Amperes |
| Isolator | 2,500 Amperes |
| Ground Switch | Not Applicable |
| Bus | 3,000 Amperes |

BRIEF SUMMARY OF THE INVENTION

In accordance with the principles of the present invention, a gas-filled enclosure may be provided, which may, for example, be a gas-filled grounded metallic tank, housing therewithin a puffer-type compressed-gas circuit-interrupter of the relatively-movable piston-and-cylinder variety, which utilizes the opening compressing motion of a movable operating gas-compressing cylinder over a relatively-fixed piston structure to compress gas therebetween, and to force said compressed arc-extinguishing gas through a movable hollow insulating nozzle to effect extinction of the established arc drawn therein by a double-gas-flow exhausting, or venting operation.

The construction of the circuit-interrupter of the present invention is such that both the stationary and movable separable contact structures are both tubular and vented, and constructed thereby desirable venting exhausting contact structure, enabling thereby a rapid exhausting, or vented flow of arced gas to occur out of the arcing region, preferably in opposite directions through the vented contact structures.

Additionally, the circuit-interrupting structure is preferably provided with circumferentially-disposed relatively-stationary main contact fingers, having enlarged extending tip portions, which improve the high electrical electrostatic field conditions existing in the gap getween the separated contact structure in the fully-open-circuit position of the interrupting device.

Additional novel features of the improved puffer-type circuit-interrupter of the present invention include secondary movable arcing contact fingers, which engage the tubular venting stationary arcing contact, additional stationary contact structure to transfer the current from either the movable operating cylinder, or, alternatively, the movable contact-operating rod for various current ratings, and features which provide for enlarged arcing contact venting areas into expanding exit regions.

Additional auxiliary features of the invention include improved assembly and disassembly operations, and other easily-accomplished maintenance features, whereby the contact structures may be replaced, when desired, for maintenance purposes.

BRIEF DESCRIPTION OF THE DRAWINGS

For a better understanding of the invention, reference may now be made to the following description of preferred embodiments of the invention, illustrated in the accompanying drawings, in which:

FIG. 2 is a sectional view taken along the line II-II of FIG. 1 looking in the direction of the arrows;

FIG. 8 is a detailed vertical sectional view of the movable contact structure;

DESCRIPTION OF THE PREFERRED EMBODIMENTS

Figure 1:
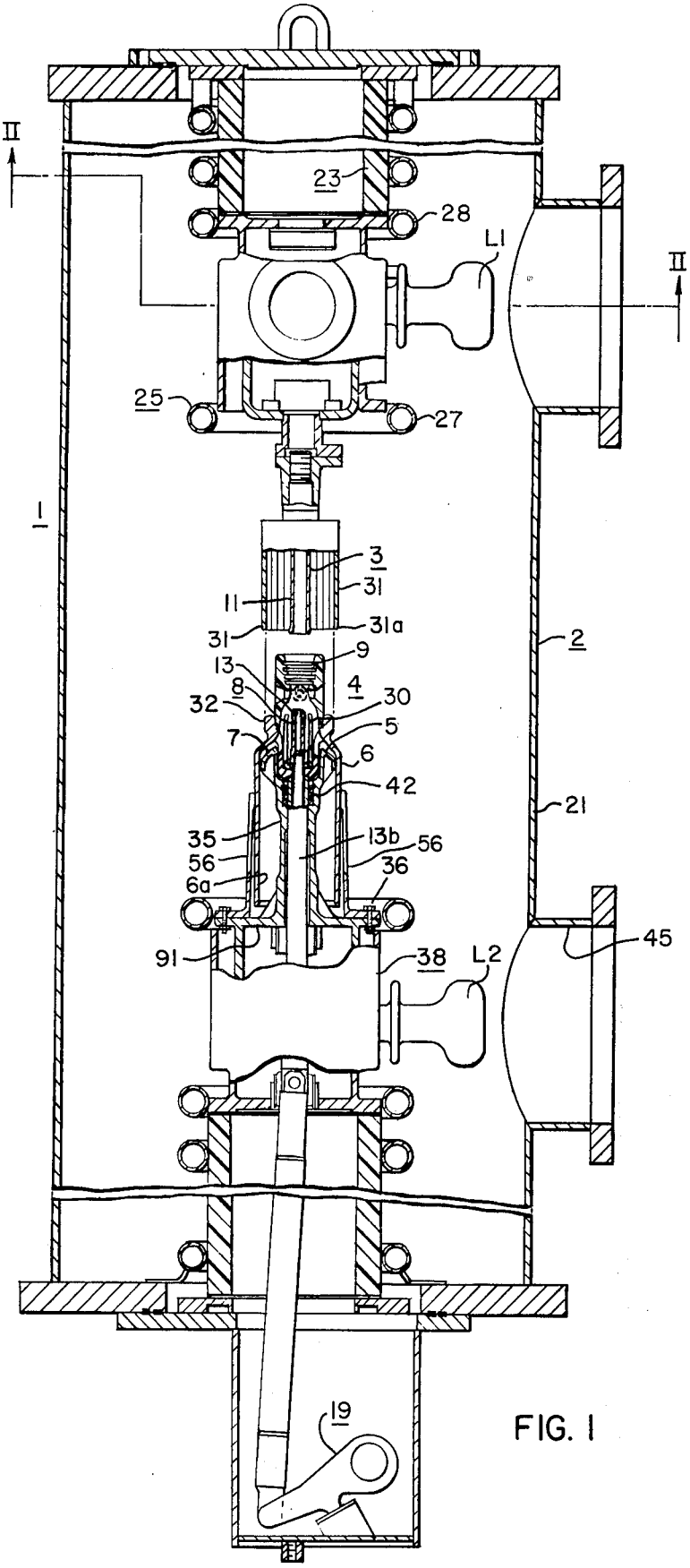
FIG. 1 is a longitudinal vertical sectional view taken through a typical gas-insulated circuit-interrupting equipment embodying the principles of the present invention, the separable contact structure of the interrupting unit being illustrated in the fully-open-circuit position.
Figure 6:
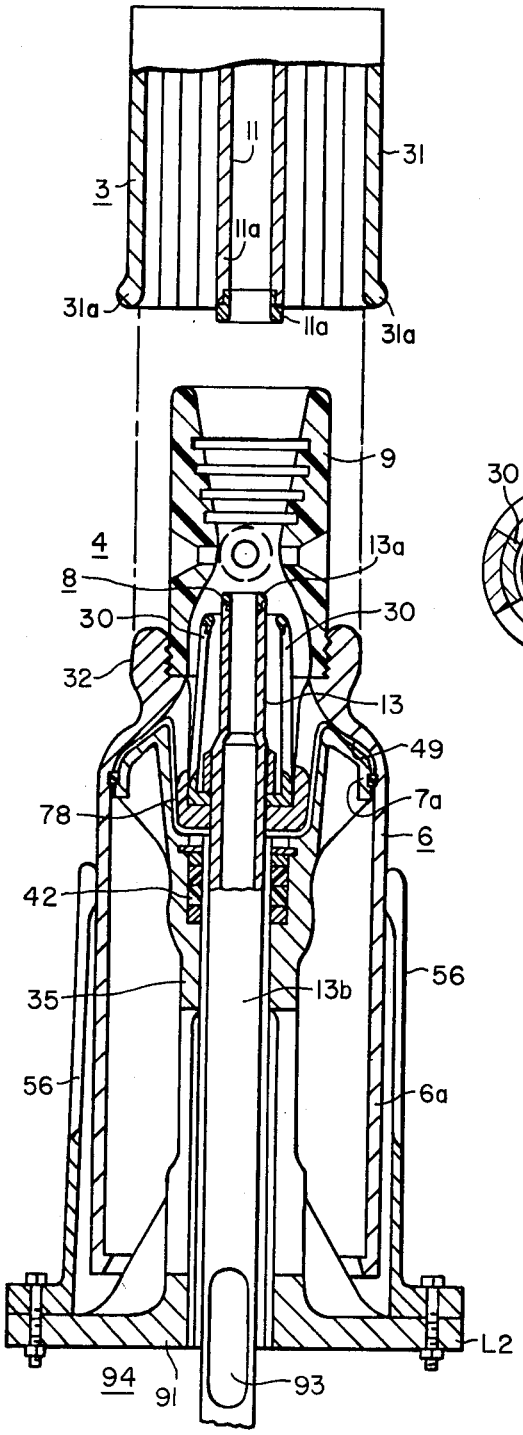
FIG. 6 is a sectional view similar to those of FIGS. 3–5, but showing the fully-open-circuit position of the breaker.

Referring to the drawings, and more particularly to FIGS. 1–6 thereof, the reference numeral 1 generally designates a structural portion of gas-insulated transmissionline equipment 2 of the type set forth in the following U.S. Pat. Nos.: Meyer 3,801,768; Wilson et al 3,700,840; Kuhn 3,694,592; Whitehead 3,610,807; Whitehead 3,378,731 and Upton, Jr. et al 3,348,001.

Figure 5:
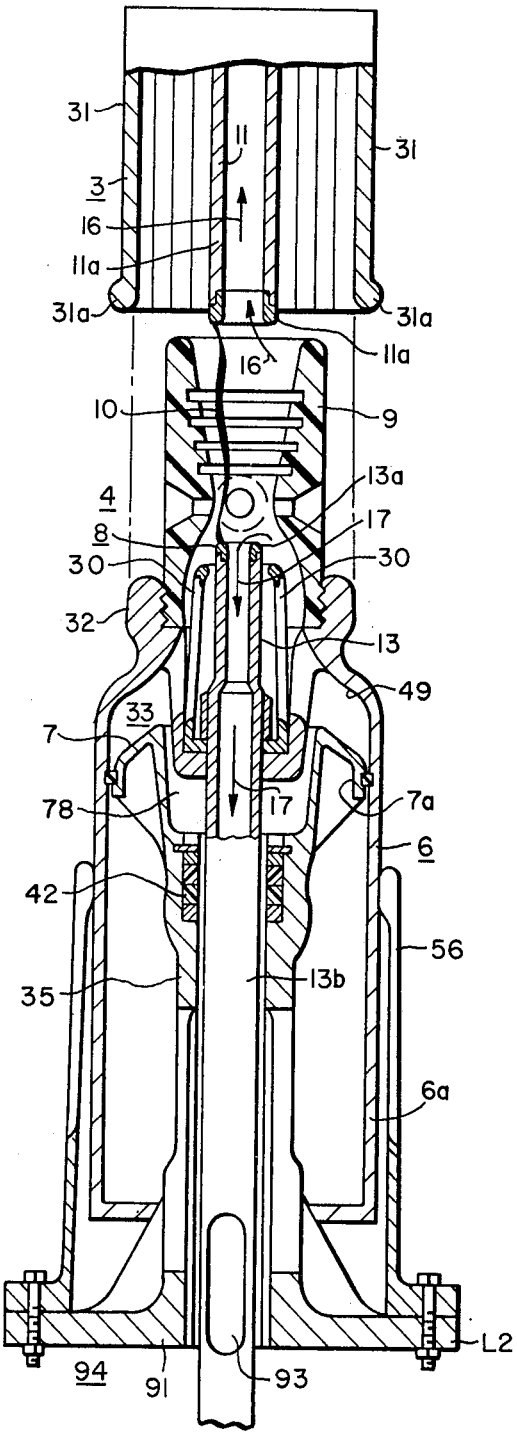
FIG. 5 is a view similar to that of FIGS. 3 and 4, but illustrating a late arcing condition occurring during the opening operation of the interrupting device.

FIG. 1, additionally, illustrates a circuit-interrupting unit 4 of the single-pressure, dual-gas-flow type in which the compressed gas 5, generated under pressure between a moving operating cylinder 6 and a stationary piston structure 7, is forced through an insulating nozzle 9 and into the established arc 10, as illustrated more clearly in FIG. 5 of the drawings. It will be observed, generally, that the gas flow exhausts in two directions, namely through and around the relatively-stationary tubular venting contact 11 in the direction indicated by the arrows 16 of FIG. 5, and also in a reverse manner in an opposite direction through the movable tubular venting contact 13, as indicated by the arrows 17 of FIG. 5. The latter is actuated by a suitable operating mechanism 19 (FIG. 1), constituting no part of the present invention, and set forth more in detail in U.S. patent application filed Dec. 31, 1975 Ser. No. 645,867 by Yeckley et al, and also patent application filed Dec. 31, 1975 Ser. No. 645,753 by Thomas E. Alverson et al, both of said patent applications being assigned to the assignee of the instant patent application.

The gas-insulated equipment 2 under discussion is particularly adaptable for 145 K.V. application, with a continuous current rating of 2,000 to 4,000 amperes. The fault current, which may have to be interrupted and accommodated by the circuit-interrupting unit 4 may total as high as 50 kA in amperage value.

In more detail, it will be observed that there is provided a generally-longitudinal tubular hollow metallic casing at ground potential, designated by the reference numeral 21. Disposed therewithin, as mounted upon an upper insulating tubular support 23, is the relatively-stationary contact structure, generally designated by the reference numeral 3, and including an electrostatic shield arrangement 25, the latter generally comprising a pair of laterally-spaced-apart metallic electrostatic rings 27, 28. The purpose of the electrostatic shielding structure 25 is to uniformly grade the electrostatic voltage of the structure to ground.

Figure 3:
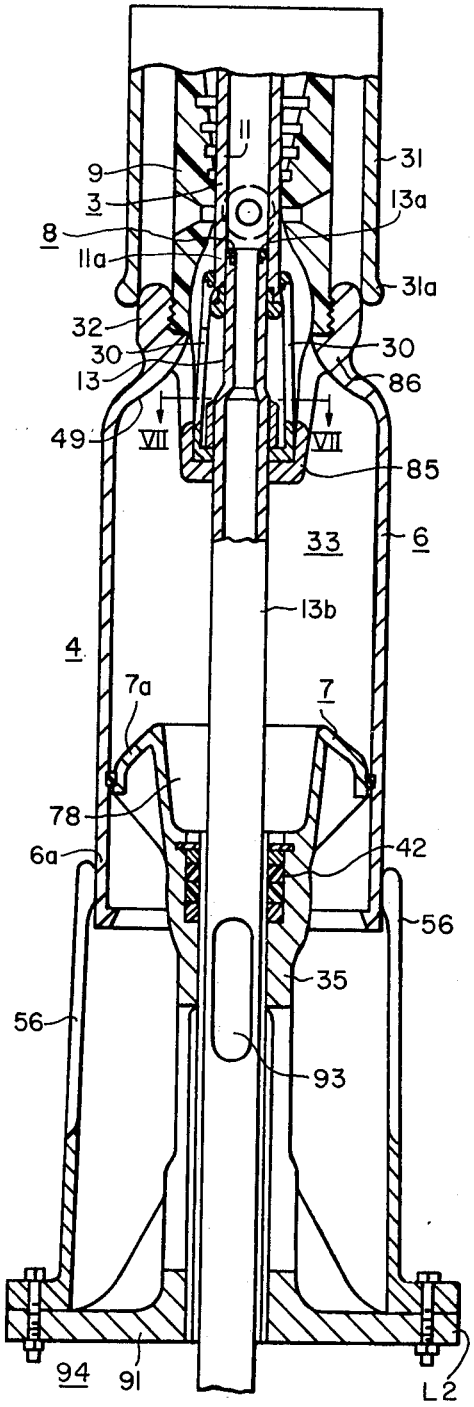
FIG. 3 is an enlarged view of the circuit-interrupting structure, or unit per se illustrating the disposition of the several contact parts in the fully-closed-circuit position of the circuit-interrupting device.

The closed-circuit position of the circuit-interrupter unit 4 is shown in FIG. 3, and it will be observed that secondary movable contact fingers 30, disposed in a generally circular fashion, make contacting engagement with the outer external annular contact surface 11*a* of the stationary movable tubular venting contact 11. For the higher current ratings, where additional contact surface area is required, the structure illustrated in FIGS. 3–6 may be utilized, in which an additional plurality of circumferentially-disposed main stationary contact fingers 31 are provided, having enlarged tip portions at their lower extended free ends, as at 31*a*.

It will be observed that these additional stationary main contact fingers 31 make contacting engagement with an annular protruding ring-shaped main movable contact portion 32, which is an integral portion of the movable operating cylinder 6, the latter cooperating with the relatively stationary piston structure 7 to generate gas under pressure within the compression region, or chamber 33.

With further attention being directed to FIGS. 3–6, it will be observed that the relatively-stationary piston structure 7 is supported by an integral cylindrical portion 35 affixed, as by bolts 36 (FIG. 1), to a stationary supporting structure 38, also shown in FIG. 1 the structure of which is more fully set forth and disclosed in the aforesaid two patent applications Ser. No. 645,753 and Ser. No. 645,867.

During the opening operation, the movable tubular venting contact-operating rod 13*b* is moved downwardly, as viewed in FIG. 1 by the lower-disposed mechanism 19, and causes initially a separation between the main stationary contact fingers 31 and the movable main contact 32, this occurring without arcing. Then occurs a subsequent separation between the auxiliary secondary movable contact fingers 30 and the stationary tubular contact 11. At a subsequent point in time, as viewed in FIG. 5, the internal tubular arcing contact tip 13*a* separates from the stationary tubular venting contact 11 to generate an arc 10 therebetween, as viewed in FIG. 5. The gas blasting through the hollow orifice structure 9, comes into intimate contact with the arc 10, and thereby effects its rapid extinction. Preferably, a suitable highly-insulating and good arc-extinguishing gas 5 is utilized within the confines of the tubular outer housing structure 21, such gas, for example, being sulfur-hexafluoride ($SF_6$) gas at a pressure for example of 45 p.s.i.g. The remarkable arc-extinguishing characteristics of this gas are set forth in detail in U.S. Pat. No. 2,757,261 issued July 31, 1956 and assigned to the assignee of the instant application.

To transfer the current from the movable conducting operating contact rod 13*b*, stationary folded ribbon contacts 42 are provided to transfer the current to the stationary supporting structure 35, through conducting supporting structure 38 to lower line terminal $L_2$, and out through a lateral pressurized grounded conduit 45 (FIG. 1) by suitable transmission-line equipment, not shown.

Figure 4:
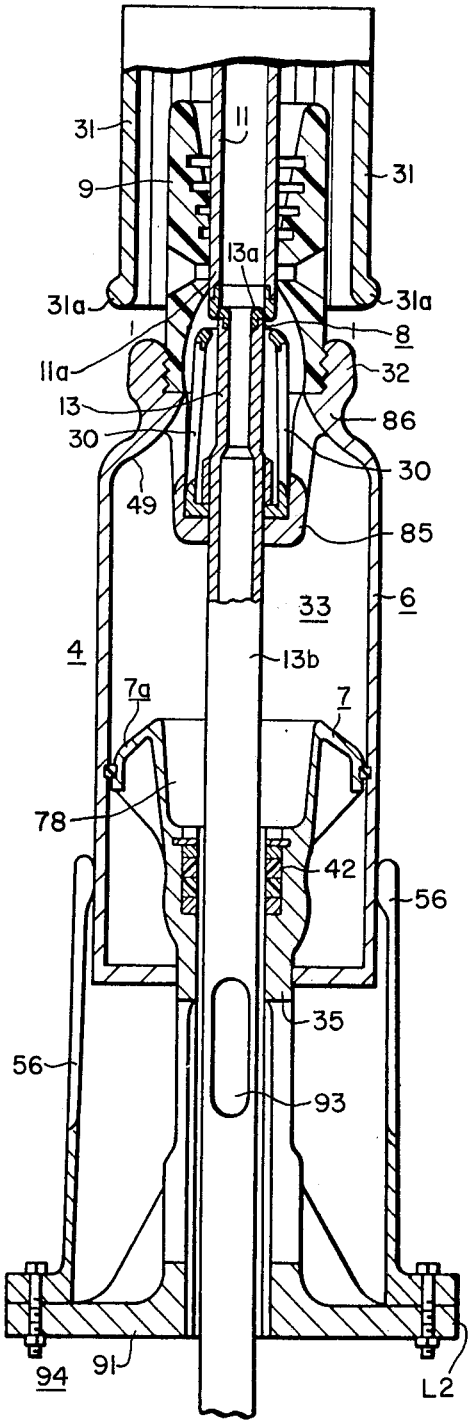
FIG. 4 is a view similar to that of FIG. 3, but illustrating the position of the several contact parts during the initial portion of the opening operation, in which the main separable contact structure has separated, but yet arcing has not yet occurred because of the continued contacting engagement between the separable arcing contacts.

For the higher-current ratings, not only may the stationary main circumferentially-arranged contact fingers 31 be used, but, additionally, stationary main contact fingers 56, as illustrated in FIG. 4 of the drawings, may also be used and maintained in good contacting engagement with the operating cylinder skirt 6*a*.

It will be observed that there is a mating conforming configuration between the inner portion 49 of the movable operating cylinder 6 and the inner annular piston-surface portion 7*a* of the relatively-stationary piston structure 7, as illustrated more clearly in FIGS. 3–6 of the drawings.

It will be observed that in FIGS. 3–5, an enlarged recess portion 78 is provided adjacent the central portion of the relatively stationary piston structure 7. A movable tubular arcing venting contact 13 is provided, having, additionally, movable secondary contact fingers 30, the latter encircling the stationary tubular venting contact 11, as indicated in FIG. 3 showing the closed-circuit position of the interrupting device 4.

Figure 7:
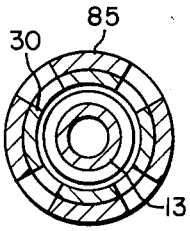
FIG. 7 is a detailed sectional plan view taken along the line VII—VII of FIG. 3, looking in the direction of the arrows.

FIG. 7 is a detailed sectional view taken through the spider-supporting portion 85 of the reverse-bend portion 86 of the movable gas-compressing operating cylinder 6. Folded, zig-zag-arranged stationary sliding contact structures of the type set forth in U.S. Pat. Nos. 3,649,946, Frowein, issued Mar. 14, 1972, and Sabol et al 3,201,535, issued Aug. 17, 1965, may be provided to transfer the line current $L_1$-$L_2$ from the movable contact-operating rod 13 to the fixed contact structure 91 of the stationary piston 7, and thereby to the external line-terminal $L_2$ of the device 4.

It will be observed that with this arrangement set forth in FIGS. 3–7, that there is no alignment problem, as far as assembly is concerned, since the annular recess 78 is uniform in all of its dimensions, and readily accommodates the spider-supporting portion 85 of the movable operating cylinder 6. Assembly and disassembly operations are thereby readily achieved.

Venting, or exhausting of the arced gases readily occurs through the movable tubular arcing contact 13 through the lateral vent openings 93 provided into the ambient region 94; consequently, exhausting and venting of the arcing gases occurs in opposite directions, to facilitate arc interruption.

FIG. 8 illustrates more in detail, and to an enlarged scale, the configuration and construction of the movable arcing contact 13, together with its associated upper movable arcing contact tip 13*a*.

Figure 9:
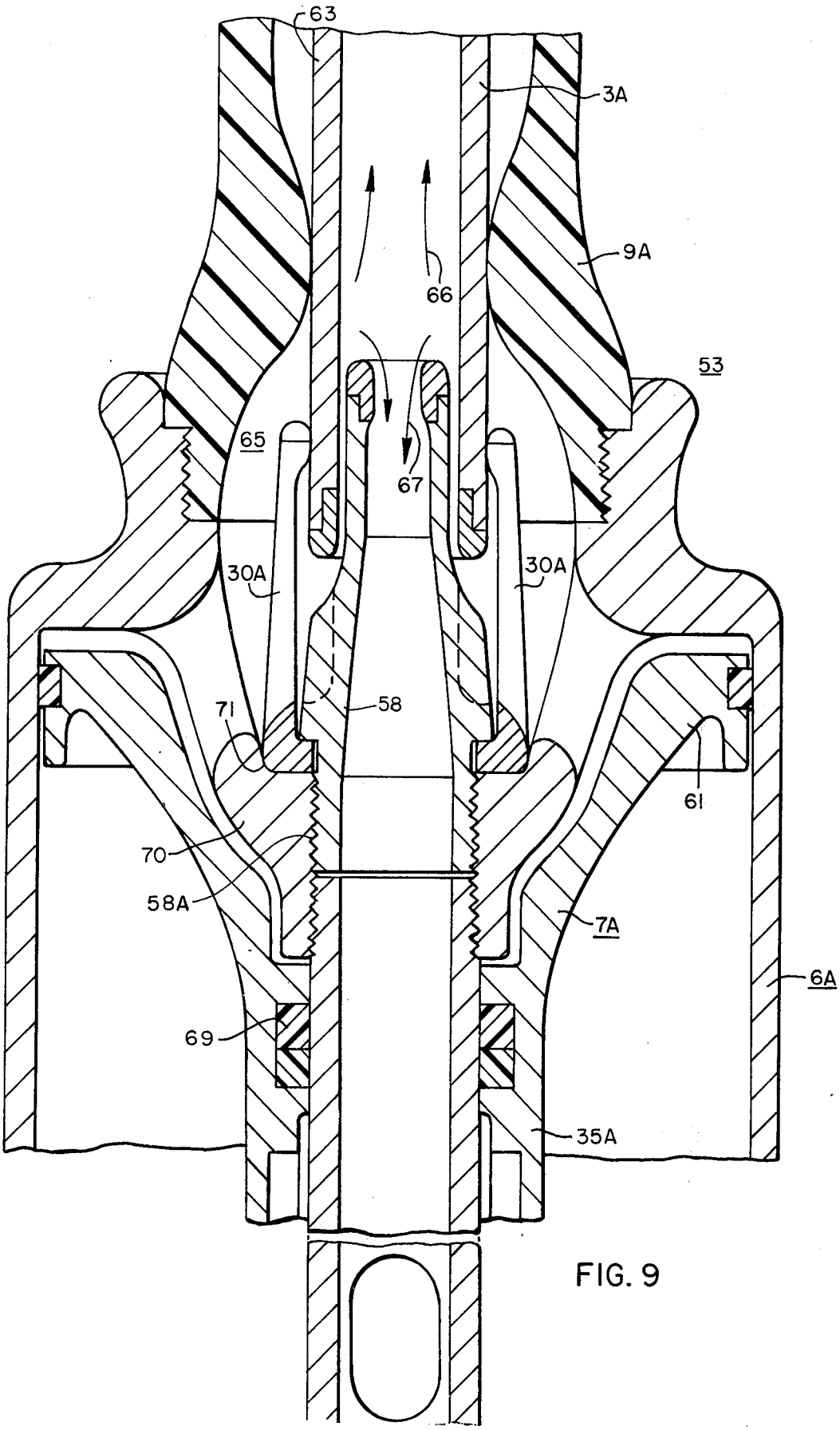
FIG. 9 illustrates a modification of the invention, the separable contact structure being illustrated in the closed-circuit position; and the stationary piston and moving cylinder shown, for purposes of illustration, in the fully open position.
Figure 10:
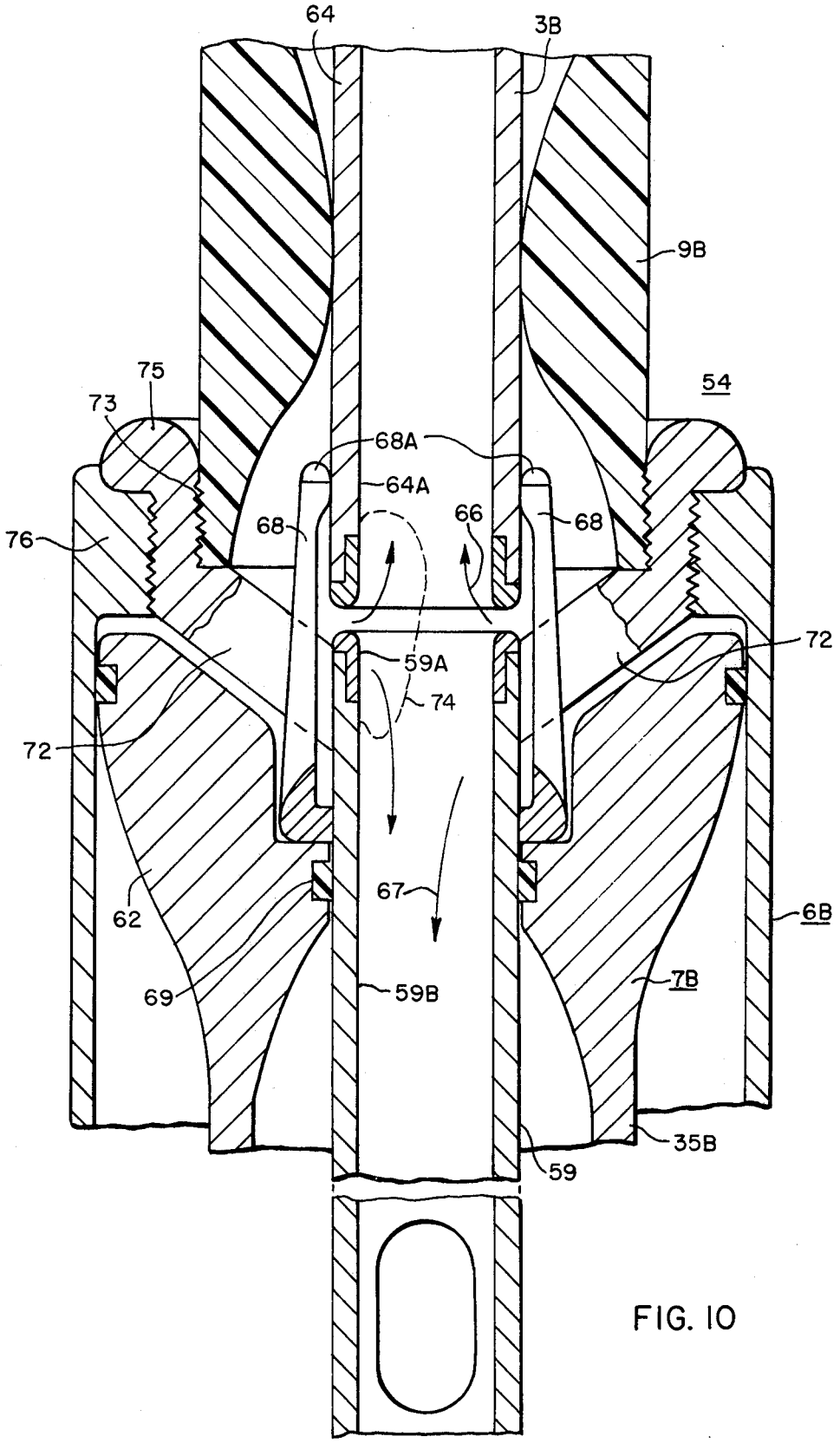
FIG. 10 illustrates yet a further embodiment of the present invention, the separable contact structure being illustrated in the closed-circuit position, and the cylinder/piston arrangement a gain being shown in the fully open-circuit position.

As will be apparent to those skilled in the art, certain modifications of the invention may be made and yet the advantages of the interrupting structure retained in effect, and thus two additional modifications are set forth in FIGS. 9 and 10 of the drawings. With reference to FIGS. 9 and 10, showing the closed positions of the modified-type of interrupting structures 53, 54, it will be observed that again an insulating nozzle 9A or 9B is provided, fixedly secured to the movable operating cylinder 6A or 6B, the latter, as before, moving over a relatively-fixed piston structure 7A or 7B. Stationary contact fingers 56, as described hereinbefore in connection with the interrupting structure of FIGS. 4 and 5, may be used to transfer current from the movable contact-operating rod 58 or 59 to the supporting structure 35A, 35B of the relatively-fixed piston structures 61 and 62. Again, exhausting or venting of the arced gases occurs through both the stationary tubular venting contact 63, 64, and also through the movable tubular venting contacts 58 or 59 in opposite directions, as indicated by the arrows 66 and 67 in FIGS. 9 and 10.

As illustrated in FIG. 10, the movable arcing contact 59 is disposed inwardly from the outer extremity of the tips 68A of the movable secondary auxiliary arcing fingers 68, both being fixedly held together in position.

With reference to FIG. 9, it will be observed that the movable tubular venting arcing contact 58, as was the case with the circuit-interrupter of FIGS. 1–5, extends farther toward the stationary contact structure 3A than the movable arcing fingers 30A. The nozzle configuration 9A, however, is of a different shape than the nozzle 9 of FIG. 5, it providing an enlarged arcing region 65 providing an expanded interrupting nozzle than was the situation in FIG. 3. Foldedtype ribbon contacts 69 are utilized to transfer current between the movable contact-operating rod 58 or 59, and the stationary supporting piston structure 35A or 35B.

As viewed in FIG. 9, it will be noted that the upper portion of the contact-operating rod 58 is threaded, as at 58A, and threadedly receives an inwardly-extending portion 70 of the movable operating cylinder 6A. As shown, the movable secondary arcing fingers 30A may be interposed in a recess portion 71 provided on the upper surface of the movable operating compression cylinder 6A, and placed under compression by the threaded securement 58A of the operating cylinder 6A upon the contact-rod 58 as well as the threaded engagement of the tubular movable contact 58.

FIG. 10 illustrates a modified-type of movable contact structure 54, in which, as shown in FIG. 10, the movable tubular arcing venting contact 59 is disposed inwardly from the protruding movable secondary arcing finger contacts 68. The upper end 59A of the movable arcing contact 59 has angularly-extending ribs 72, which are threadedly secured, as at 73, to the upper insulating nozzle 9B. The ring-shaped portion 75 of the arms 72 may threadedly receive the sleeve portion 76 of the movable operating cylinder 6B, as shown. With such a contact construction, as illustrated in FIG. 10, it will be observed that the movable secondary arcing contact fingers 68 make final parting engagement last with the stationary tubular venting contact 64. The established arc (not shown) is moved by the gas blast onto the interior side-walls 64A, 59B of the movable tubular arcing contacts 64 and 59, as indicated by the dotted line 74.

Although there have been illustrated and described specific structures, it is to be clearly understood that the same were merely for the purpose of illustration, and that changes and modifications may readily be made therein by those skilled in the art, without departing from the spirit and scope of the invention.

We claim:

1. A double-flow, puffer-type compressed-gas circuit-interrupter adaptable for high-current ratings including means defining a relatively-stationary contact structure, said relatively-stationary contact structure including a cluster of stationary main contact fingers (31) disposed in a generally cylindrical arrangement and a centrally-disposed stationary tubular arcing contact (11), means defining a cooperable movable contact structure (8), a movable operating-cylinder assembly (6) carrying said movable contact structure (8) and an insulating nozzle, said movable operating-cylinder assembly (6) having disposed thereon adjacent its forward end an annular relativelyheavy movable main contact (32) making cooperable engagement with said cluster of stationary main contact fingers (31) in the closed-circuit position of the circuit-interrupter, means defining a relatively-fixed piston member (7), said movable operating-cylinder assembly (6) slidable over said relatively-fixed piston member (7) during the opening operation, said movable contact assembly (8) additionally carrying a centrally-disposed movable tubular arc horn (13*a*) at its forward end which enters the stationary tubular arcing contact (11) in the closed-circuit position of the device, gas being compressed between the movable operating cylinder and the relatively-fixed piston to be forced out of the movable cylinder assembly through said hollow insulating nozzle (9) into engagement with the established arc drawn within the hollow movable nozzle (9) and between the stationary tubular contact (11) and the movable tubular arc horn (13*a*) during the opening operation of the device, the movable insulating nozzle (9) making close valve-like engagement with the stationary tubular arcing contact (11) for an appreciable time following separation of the arcing contacts (11, 13*a*), double-flow gas exhausting through said separated arcing contacts (11, 13*a*) immediately following their separation during the opening operation of the circuit-interrupter, said cluster of main contact fingers (31) first parting contacting engagement with the main movable annular contact (32) of the movable operating cylinder assembly (6) during the opening operation, and then at a subsequent point in time the movable auxiliary fingers (30) parting contacting engagement with the relatively-stationary tubular arcing contact (11), so that final contacting separation occurs between the movable tubular arc horn (13*a*) and the relatively-stationary tubular arcing contact (11).

2. The combination according to claim 1, wherein the movable insulating nozzle (9) is relatively short in its axial length and also extends within the cluster of stationary main contact fingers (31) in the closed-circuit position of the device.

3. The combination according to claim 1, wherein the movable insulating nozzle (9) has a plurality of radially-outwardly-extending venting holes extending from the restricted throat portion of the hollow insulating nozzle (9).

4. The combination according to claim 1, wherein the relatively-fixed piston structure (7) has a centrally-disposed cavity of annular configuration, a movable contact-operating rod extends centrally through the fixed piston structure and also through said annular cavity for operating the movable operating cylinder assembly (6), and the movable operating cylinder assembly having an enlarged mating boss portion (85) which enters said stationary cavity in complementary fashion during the opening operation to minimize the "dead" volume of gas between the movable operating cylinder and the fixed piston at the end of the opening operation of the device.

5. The combination according to claim 1, wherein a plurality of sliding ring-shaped contacts (42) are supported by the fixed piston structure and bear upon the side of the movable contact operating rod to carry current thereto.

6. The combination according to claim 1, wherein a plurality of stationary contact fingers are provided to bear into contacting engagement on the outer side of the movable operating cylinder, a conducting contact operating rod (20) passes centrally through the fixed piston structure (26), and a plurality of ring-shaped contacts (42) bear upon the movable conducting contact operating rod (13*b*) to carry current thereto from the fixed piston structure.

7. The combination according to claim 1, wherein the gas-flow areas upstream of the nozzle-throat gradually decreases thereby minimizing pressure drops and increasing the pressure at the nozzle for improved interrupting performance.

8. The combination according to claim 1, wherein the forward extending ends of the stationary main contact fingers (31) have enlarged rounded portions (31*a*) to enable the circuit-interrupter to have a high electrical voltage-withstand capability.

* * * * *